US010875158B2

(12) United States Patent
Shen

(10) Patent No.: US 10,875,158 B2
(45) Date of Patent: Dec. 29, 2020

(54) TOOL WITH FUNCTION OF FASTENING AND CUTTING CLAMPING BAND

(71) Applicant: ZHUJI ITOP HARDWARE TOOLS Co., Ltd., Zhuji (CN)

(72) Inventor: Yuejuan Shen, Zhuji (CN)

(73) Assignee: Zhujitop Hardware Tools Co., Ltd., Zhuji (CN)

( * ) Notice: Subject to any disclaimer, the term of this patent is extended or adjusted under 35 U.S.C. 154(b) by 316 days.

(21) Appl. No.: 16/118,418

(22) Filed: Aug. 30, 2018

(65) Prior Publication Data

US 2019/0202036 A1 Jul. 4, 2019

(30) Foreign Application Priority Data

Dec. 31, 2017 (CN) ..... 2017 2 1916814 U

(51) Int. Cl.

| | |
|---|---|
| ***B25B 7/22*** | (2006.01) |
| ***B25B 7/12*** | (2006.01) |
| ***B26B 17/02*** | (2006.01) |
| ***B25F 1/00*** | (2006.01) |
| ***B26B 17/00*** | (2006.01) |

(52) U.S. Cl.

CPC ..... *B25B 7/22* (2013.01); *B25B 7/12* (2013.01); *B25F 1/003* (2013.01); *B26B 17/006* (2013.01); *B26B 17/02* (2013.01)

(58) Field of Classification Search

CPC ..... B25F 1/003; B26B 17/006; B26B 17/02; B25B 7/22; B25B 7/12

See application file for complete search history.

(56) References Cited

U.S. PATENT DOCUMENTS

| | | | | |
|---|---|---|---|---|
| 6,832,532 | B2 * | 12/2004 | Kilpela | A61B 17/82 81/315 |
| 6,862,962 | B1 * | 3/2005 | Delbrugge, Jr. | B25B 7/10 81/355 |
| 6,892,460 | B2 * | 5/2005 | Wilhelm | G02B 6/25 30/134 |
| 7,886,570 | B2 * | 2/2011 | Cleland | B25B 27/10 72/409.1 |
| 8,015,853 | B2 * | 9/2011 | Steiner | B25B 7/04 72/409.12 |
| 8,087,137 | B2 * | 1/2012 | Wang | B25B 7/12 29/266 |
| 8,393,254 | B2 * | 3/2013 | Gao | B25B 7/12 81/420 |
| 2010/0175516 | A1 * | 7/2010 | Zhang | B25B 7/02 81/402 |

* cited by examiner

*Primary Examiner* — David B. Thomas

(74) *Attorney, Agent, or Firm* — Schwegman Lundberg & Woessner, P.A.

(57) ABSTRACT

This invention provides a tool with a function of fastening and cutting a clamping band, including a left pliers head, a right pliers head and a switching structure. The right pliers head and the left pliers head cooperate with each other to fasten and cut the clamping band. The switching structure is disposed at the left pliers head and the right pliers head to adjust the distance between the left pliers head and the right pliers head when the left pliers head and the right pliers head clamp tightly. The tool with the function of fastening and cutting the clamping band provided in this invention achieves one tool with two functions.

11 Claims, 4 Drawing Sheets

TOOL WITH FUNCTION OF FASTENING AND CUTTING CLAMPING BAND

CROSS-REFERENCE TO RELATED APPLICATIONS

This Non-provisional application claims priority under 35 U.S.C. § 119(a) on Chinese Patent Application No(s). 201721916814.5 filed on Dec. 31, 2017, the entire contents of which are hereby incorporated by reference.

BACKGROUND OF THE INVENTION

Field of the Invention

This invention relates to a technical field of tool, and more particularly, to a tool with a function of fastening and cutting a clamping band.

Description of the Related Art

With the rapid development of infrastructure construction and environmental protection, the use of plastic and metal pipes is becoming more and more frequent, and hot melting, welding and clamp connecting are commonly used in the connection of plastic and metal pipes. Among them, connection methods such as hot melting and welding need to consume heat energy and will damage the material performance. In comparison, the clamp connecting of the fastening connection not only has less leakage points, is safe and reliable, does not require heat consumption, has little effect on the material performance, but also is very convenient to construct.

However, the clamp connecting in the prior art also has certain technical defects. When the clamp connecting needs to be released, the pry method is often adopted, which is harmful to the pipes. Moreover, the realization of releasing and fastening requires the use of two different tools, respectively, which increases the weight of the tools for an operator and is very inconvenient.

BRIEF SUMMARY OF THE INVENTION

In order to overcome at least one deficiency of the prior art, this invention provides a tool with a function of fastening and cutting a clamping band.

In order to achieve above-mentioned objectives, this invention provides the tool with the function of fastening and cutting the clamping band, including a left pliers head, a right pliers head and a switching structure. The right pliers head and the left pliers head cooperate with each other to fasten and cut the clamping band. The switching structure is disposed at the left pliers head and the right pliers head to adjust the distance between the left pliers head and the right pliers head when the left pliers head and the right pliers head clamp tightly.

Optionally, the switching structure may include a cover plate, a cover plate shaft and an eccentric shaft, the cover plate may be disposed at one side of the left pliers head and the right pliers head, and the cover plate shaft and the eccentric shaft may be disposed at the left pliers head and the right pliers head, respectively. The eccentric shaft may be eccentrically and rotatably disposed, and one end of the cover plate shaft may be provided with a positioning structure.

Optionally, the switching structure further may include a back cover plate and a switching sheet, the back cover plate may be disposed at the other side of the left pliers head and the right pliers head, and the switching sheet may be connected with the back cover plate. One end of the eccentric shaft may have a limiting slot, and the limiting slot and the switching sheet may cooperate with each other to achieve the rotation of the eccentric shaft. The other end of the cover plate shaft may be connected with the back cover plate.

Optionally, the cover plate may have a limiting hole, the other end of the eccentric shaft may be provided with a limiting block, and the limiting block and the limiting hole may cooperate with each other to fix the eccentric shaft.

Optionally, the left pliers head and the right pliers head may both have a slot, the tool with the function of fastening and cutting the clamping band further may include a positioning shaft, and two sides of the positioning shaft may cooperate with the slot of the left pliers head and the slot of the right pliers head, respectively, to fasten the clamping band.

Optionally, the left pliers head may have a positioning slot, the right pliers head may have a positioning protrusion, and the positioning slot and the positioning protrusion may cooperate with each other to cut the clamping band.

Optionally, the left pliers head and the right pliers head may both have a round slot, and the round slot of the left pliers head and the round slot of the right pliers head may cooperate with each other to form a cavity used to accommodate the clamping band.

Optionally, the tool with the function of fastening and cutting the clamping band may further include a left pliers handle and a right pliers handle, the left pliers handle may be connected with the right pliers head, and the right pliers handle may be connected with the right pliers head.

Optionally, the tool with the function of fastening and cutting the clamping band may further include a pliers handle shaft, a ratchet plate and a ratchet paw. The left pliers handle may be connected with the right pliers handle by the pliers handle shaft, the ratchet plate may be inserted into the pliers handle shaft, the ratchet plate may be engaged with the ratchet paw, and the ratchet paw may be inserted into the right pliers handle or the left pliers handle.

Optionally, the tool with the function of fastening and cutting the clamping band may further include an adjusting nut, and the adjusting nut may be disposed at the left pliers handle or the right pliers handle to control an engaging state of the ratchet paw and the ratchet plate.

In summary, the tool with the function of fastening and cutting the clamping band provided in this invention uses the switching structure to switch two working states of the tool, to make one tool have two functions, the weight and occupied volume of one tool are smaller than two separate tools added together, and the cost price is relatively low.

Meanwhile, by taking advantage of the cooperation between the switching sheet and the limiting slot and the cooperation between the limiting block and the limiting hole, the eccentric shaft is fixed, such that the stability of the whole tool is increased. Through the eccentric and rotatable disposing of the eccentric shaft, the distance between the left pliers head and the right pliers head when clamp tightly is changed, thus realize the transition of the two working states, and the structure is simple.

DETAILED DESCRIPTION OF THE INVENTION

These and other objects, features and advantages of the present invention will become better understood with the following preferred embodiments, accompanying drawings and description in detail.

Figure 1:
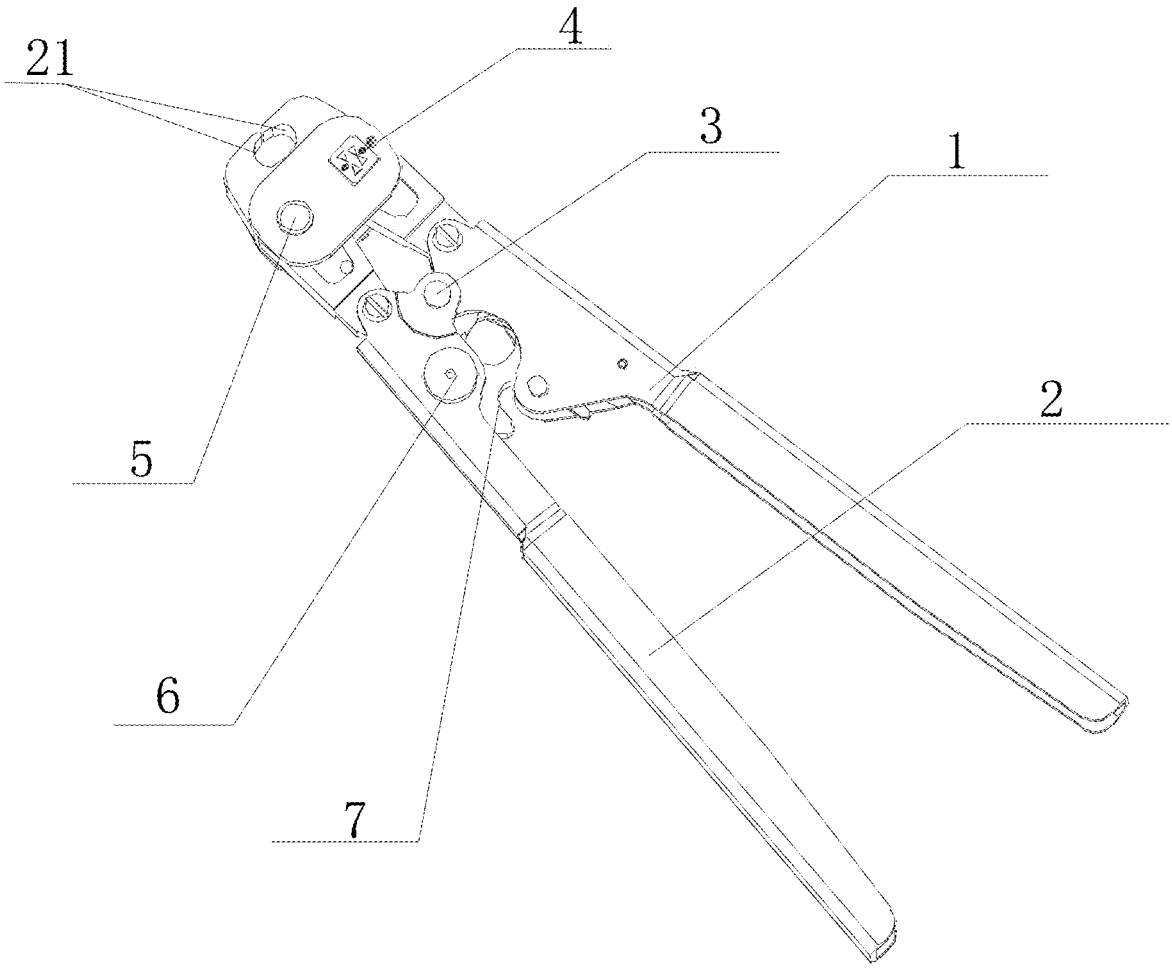
FIG. 1 is a schematic diagram of a front side of a tool with a function of fastening and cutting a clamping band according to the embodiment of the present invention.
Figure 2:
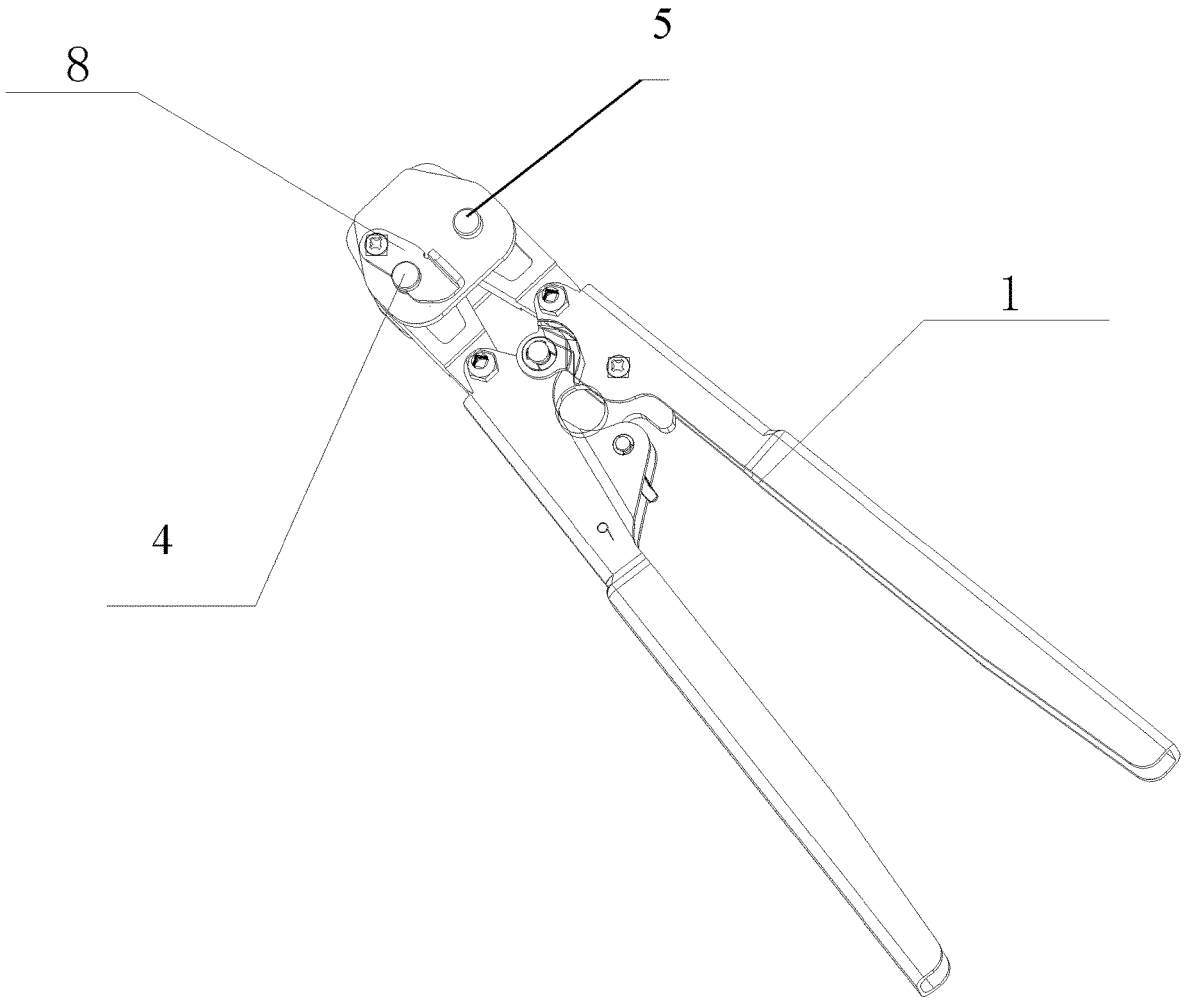
FIG. 2 is a schematic diagram of a back side of the tool with the function of fastening and cutting the clamping band according to the embodiment of the present invention.
Figure 3:
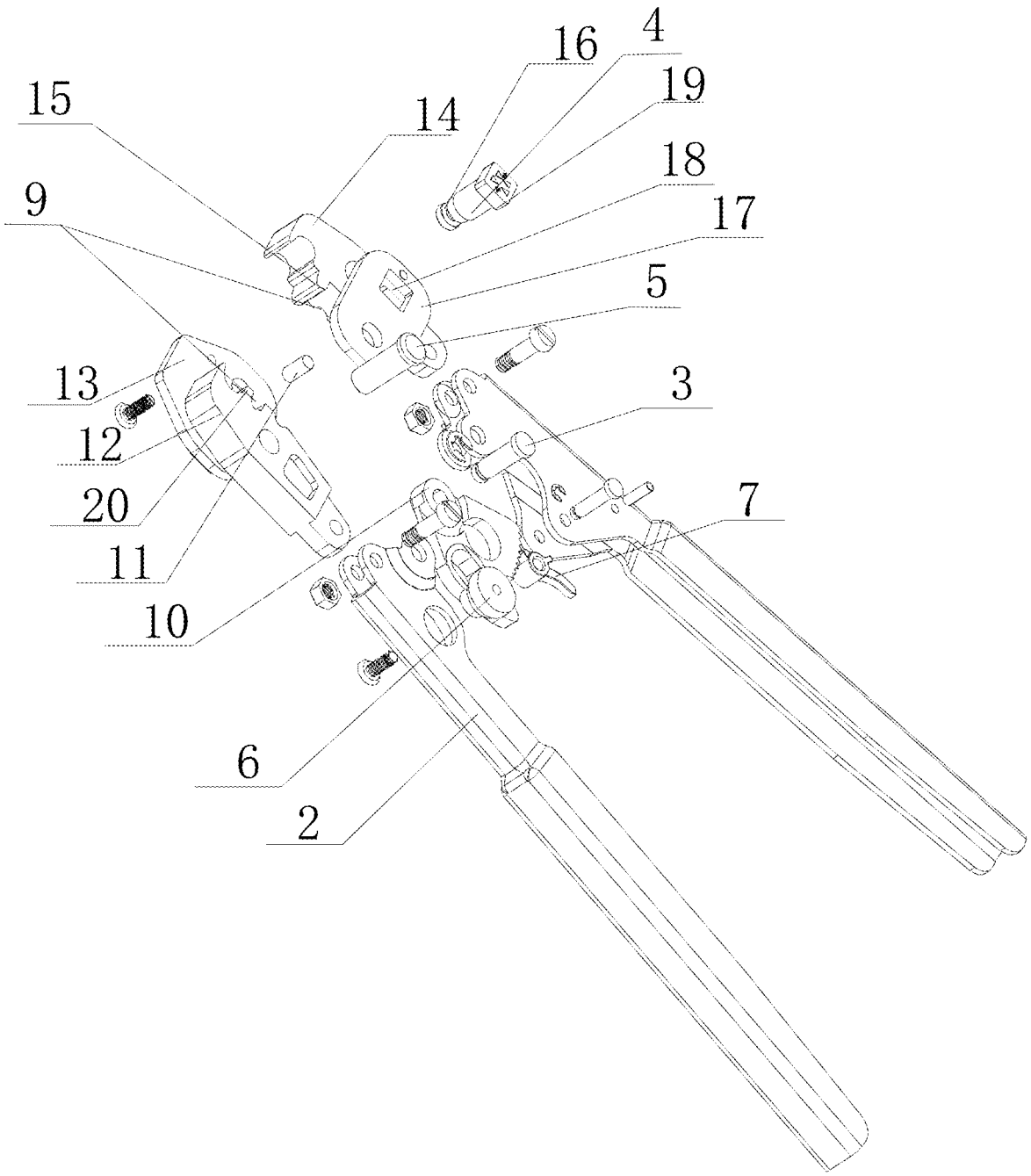
FIG. 3 is an exploded diagram of the tool with the function of fastening and cutting the clamping band according to the embodiment of the present invention.
Figure 4:
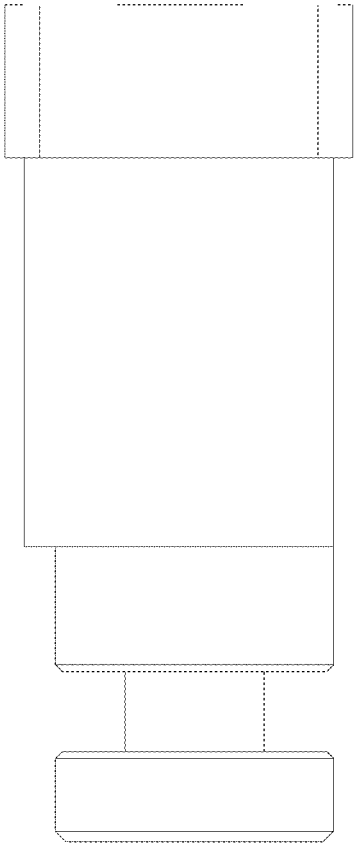
FIG. 4 is a front view of an eccentric shaft according to the embodiment of the present invention.
Figure 5:
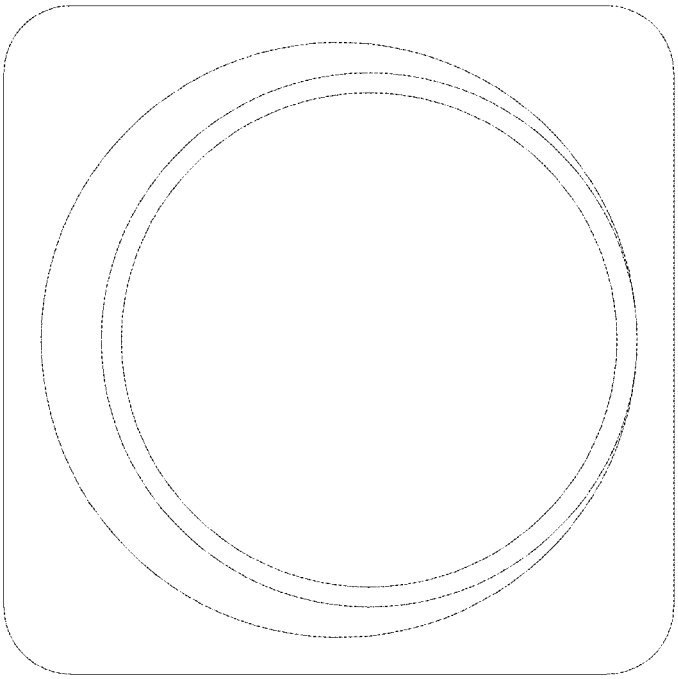
FIG. 5 is a bottom view of the eccentric shaft according to the embodiment of the present invention.

Please refer to FIG. 1 to FIG. 5. This invention provides a tool with a function of fastening and cutting a clamping band, including a left pliers head 12, a right pliers head 14 and a switching structure. The right pliers head 14 and the left pliers head 12 cooperate with each other to fasten and cut the clamping band. The switching structure is disposed at the left pliers head 12 and the right pliers head 14 to adjust the distance between the left pliers head 12 and the right pliers head 14 when the left pliers head 12 and the right pliers head 14 clamp tightly. This tool uses the switching structure to switch two working states of the tool to make one tool have two functions, the weight and occupied volume of one tool are smaller than two separate tools added together, and the cost price is relatively low.

In this embodiment, the switching structure includes a cover plate 17, a cover plate shaft 5 and an eccentric shaft 4, the cover plate 17 is disposed at one side of the left pliers head 12 and the right pliers head 14, and the cover plate shaft 5 and the eccentric shaft 4 are disposed at the left pliers head 12 and the right pliers head 14, respectively. In this embodiment, the cover plate shaft 5 is disposed at the left pliers head 12, and the eccentric shaft 4 is disposed at the right pliers head 14. However, in other embodiments, the cover plate shaft 5 may further be disposed at the right pliers head 14, and the eccentric shaft 4 may further be disposed at the left pliers head 12. One end of the cover plate shaft 5 is provided with a positioning structure. The positioning structure is used for fixing the relative position of the cover plate 17 and the left pliers head 12. In this embodiment, the cover plate shaft 5 is cylinder-shaped, but this invention does not limit the shape of the cover plate shaft 5. The eccentric shaft 4 is eccentrically and rotatably set, with the rotation of the eccentric shaft 4, the distance between the left pliers head 12 and the right pliers head 14 when clamp tightly changes, thus to switch two working states of the tool.

In this embodiment, the switching structure further includes a back cover plate 13 and a switching sheet 8, the back cover plate 13 is disposed at the other side of the left pliers head 12 and the right pliers head 14, and one end of the switching sheet 8 is connected with the back cover plate 13 by a screw element. One end of the eccentric shaft 4 has a limiting slot 16, and the limiting slot 16 and the switching sheet 8 cooperate with each other to achieve the rotation of the eccentric shaft 4. The other end of the cover plate shaft 5 is connected with the back cover plate 13. The back cover plate 13 can hide part of the left pliers head 12 and the right pliers head 14, and the area of thrust surface is increased, and the tension of the cover plate shaft 17 is evenly distributed on the back cover plate 13, thereby increasing the entire service life of the tool. However, this invention does not limit the structure of the back cover plate 13, in other embodiments, one end of the switching sheet 8 is connected with the right pliers head 14 by the screw element directly, and the other end of the cover plate shaft 5 is connected with the left pliers head 12.

In this embodiment, the cover plate 17 has a limiting hole 18, the other end of the eccentric shaft 4 is provided with a limiting block 19, and the limiting block 19 and the limiting hole 18 cooperate with each other to fix the position of the eccentric shaft 4. One section of the limiting block 19 and the limiting hole 18 are both square shaped, but this invention does not limit the shape of the limiting block 19 and the limiting hole 18, in other embodiments, the section of the limiting block 19 and the limiting hole 18 may both be center-symmetric and angular shapes.

In practice, when the tool is in the process of fastening or cutting, the limiting slot 16 and the switching sheet 8 are engaged with each other for fixing the position of the eccentric shaft 4. Meanwhile, the switching sheet 8 is rotatable around one end of the switching sheet 8. When the working state needs to be switched, the switching sheet 8 is rotated, the limiting slot 16 and the switching sheet 8 are separated, and the limiting block 19 at the other end of the eccentric shaft 4 rushes out of the limiting hole 18 by pressing one end of the eccentric shaft 4, thereby realizing the rotation of the eccentric shaft 4. When the rotation is complete, since the eccentric shaft 4 is eccentrically disposed, the distance between the left pliers head 12 and the right pliers head 14 is changed, thereby realizing the switch of two working states. After the eccentric shaft 4 is rotated, the limiting block 19 returns back inside the limiting hole 18 by pressing the other end of the eccentric shaft 4, the switching sheet 8 is rotated, such that the limiting slot 16 and the switching sheet 8 are engaged and fixed to increase the structural stability of the tool. In summary, this tool uses the cooperation between the switching sheet 8 and limiting slot 16, the cooperation between the limiting block 19 and the limiting hole 18 to fix the position 4 of the eccentric shaft, thus to increase the stability of the whole tool. Through the eccentric and rotatable disposing of the eccentric shaft 4, the distance between the left pliers head and the right pliers head when clamp tightly is changed, thus realize the transition of the two working states, and the structure is simple.

In this embodiment, the left pliers head 12 and the right pliers head 14 both have a slot 9, the tool further includes a positioning shaft 11, and two sides of the positioning shaft 11 cooperate with the slot 9 of the left pliers head 12 and the slot 9 of the right pliers head 14, respectively, to fasten the clamping band. The left pliers head 12 has a positioning slot 20, the right pliers head 14 has a positioning protrusion, and the positioning slot 20 and the positioning protrusion 15 cooperate with each other to cut the clamping band, thus to increase the stability of the tool.

In this embodiment, the left pliers head 12 and the right pliers head 14 both have a round slot 21, and the round slot 21 of the left pliers head 12 and the round slot 21 of the right pliers head 14 cooperate with each other to form a cavity used to accommodate the clamping band, thus the clamping band can be placed in the cavity and to be fastened.

In the embodiment, the tool further includes a left pliers handle 2 and a right pliers handle 1, the left pliers handle 2 is connected with the right pliers head 12, and the right pliers handle 1 is connected with the right pliers head 14. The set of the left pliers handle 2 and the right pliers handle 1 increases the torque, making it easier to use.

In this embodiment, the tool further includes a pliers handle shaft 3, a ratchet plate 10 and a ratchet paw 7. The left pliers handle 2 is connected with the right pliers handle 1 by the pliers handle shaft 3, the ratchet plate 10 is inserted into the pliers handle shaft 3, the ratchet plate 10 is engaged with the ratchet paw 7, and the ratchet paw 7 is inserted into the right pliers handle 1 or the left pliers handle 2. The disposing of the pliers handle shaft 3, the ratchet plate 10 and the ratchet paw 7 can make the left pliers handle 2 and the right pliers handle 1 in the state of fastening automatically return to their original positions after losing the external force.

In this embodiment, the tool further includes an adjusting nut 6, and the adjusting nut 6 is disposed at the left pliers handle 2 or the right pliers handle 1 to control an engaging state of the ratchet paw 7 and the ratchet plate 10.

Those skilled in the art should understand that, in the disclosure of the present invention, terminologies of "longitudinal," "lateral," "upper," "front," "back," "left," "right," "perpendicular," "horizontal," "top," "bottom," "inner," "outer," and etc. just indicate relations of direction or position are based on the relations of direction or position shown in the appended drawings, which is only to facilitate descriptions of the present invention and to simplify the descriptions, rather than to indicate or imply that the referred device or element must be arranged in such a specific direction or to be operated or configured in specific direction. Therefore, the above mentioned terminologies shall not be interpreted as a limitation to the present invention.

Although the present invention has been described in considerable detail with reference to certain preferred embodiments thereof, the disclosure is not for limiting the scope of the invention. Persons having ordinary skill in the art may make various modifications and changes without departing from the scope and spirit of the invention. Therefore, the scope of the appended claims should not be limited to the description of the preferred embodiments described above.

What is claimed is:

1. A tool with a function of fastening and cutting a clamping band, comprising:

a left pliers head;

a right pliers head and the left pliers head cooperating with each other to fasten and cut the clamping band; and a switching structure, disposed at the left pliers head and the right pliers head to adjust a distance between the left pliers head and the right pliers head when the left pliers head and the right pliers head clamp tightly;

wherein the switching structure comprises a cover plate, a cover plate shaft and an eccentric shaft, the cover plate is disposed at one side of the left pliers head and the right pliers head, the cover plate shaft and the eccentric shaft are disposed at the left pliers head and the right pliers head, respectively, the eccentric shaft is eccentrically and rotatably disposed, and one end of the cover plate shaft is provided with a positioning structure.

2. The tool with the function of fastening and cutting the clamping band according to claim 1, wherein the switching structure further comprises a back cover plate and a switching sheet, the back cover plate is disposed at the other side of the left pliers head and the right pliers head, the switching sheet is connected with the back cover plate, one end of the eccentric shaft has a limiting slot, the limiting slot and the switching sheet cooperate with each other to achieve rotation of the eccentric shaft, and the other end of the cover plate shaft is connected with the back cover plate.

3. The tool with the function of fastening and cutting the clamping band according to claim 2, wherein the cover plate has a limiting hole, the other end of the eccentric shaft is provided with a limiting block, and the limiting block and the limiting hole cooperate with each other to fix the eccentric shaft.

4. The tool with the function of fastening and cutting the clamping band according to claim 1, wherein the left pliers head and the right pliers head both have a slot, the tool with the function of fastening and cutting the clamping band further comprises a positioning shaft, and two sides of the positioning shaft cooperate with the slot of the left pliers head and the slot of the right pliers head, respectively, to fasten the clamping band.

5. The tool with the function of fastening and cutting the clamping band according to claim 1, wherein the left pliers head has a positioning slot, the right pliers head has a positioning protrusion, and the positioning slot and the positioning protrusion cooperate with each other to cut the clamping band.

6. The tool with the function of fastening and cutting the clamping band according to claim 1, wherein the left pliers head and the right pliers head both have a round slot, and the round slot of the left pliers head and the round slot of the right pliers head cooperate with each other to form a cavity for accommodating the clamping band.

7. The tool with the function of fastening and cutting the clamping band according to claim 1, further comprising a left pliers handle and a right pliers handle, wherein the left pliers handle is connected with the right pliers head, and the right pliers handle is connected with the right pliers head.

8. The tool with the function of fastening and cutting the clamping band according to claim 7, further comprising a pliers handle shaft, a ratchet plate and a ratchet paw, wherein the left pliers handle is connected with the right pliers handle by the pliers handle shaft, the ratchet plate is inserted into the pliers handle shaft, the ratchet plate is engaged with the ratchet paw, and the ratchet paw is inserted into the right pliers handle or the left pliers handle.

9. The tool with the function of fastening and cutting the clamping band according to claim 8, further comprising a adjusting nut, wherein the adjusting nut is disposed at the left pliers handle or the right pliers handle to control an engaging state of the ratchet paw and the ratchet plate.

10. A tool with a function of fastening and cutting a clamping band, comprising:

a left pliers head;

a right pliers head and the left pliers head cooperating with each other to fasten and cut the clamping band; and a switching structure, disposed at the left pliers head and the right pliers head to adjust a distance between the left pliers head and the right pliers head when the left pliers head and the right pliers head clamp tightly;

wherein the left pliers head and the right pliers head both have a slot, the tool with the function of fastening and cutting the clamping band further comprises a positioning shaft, and two sides of the positioning shaft cooperate with the slot of the left pliers head and the slot of the right pliers head, respectively, to fasten the clamping band.

11. A tool with a function of fastening and cutting a clamping band, comprising:

a left pliers head;

a right pliers head and the left pliers head cooperating with each other to fasten and cut the clamping band; and a switching structure, disposed at the left pliers head and the right pliers head to adjust a distance between the left pliers head and the right pliers head when the left pliers head and the right pliers head clamp tightly;

wherein the tool further comprises a left pliers handle and a right pliers handle, wherein the left pliers handle is connected with the right pliers head, and the right pliers handle is connected with the right pliers head;

wherein the tool further comprises a pliers handle shaft, a ratchet plate and a ratchet paw, wherein the left pliers handle is connected with the right pliers handle by the pliers handle shaft, the ratchet plate is inserted into the pliers handle shaft, the ratchet plate is engaged with the ratchet paw, and the ratchet paw is inserted into the right pliers handle or the left pliers handle.

* * * * *